US008113178B2

(12) United States Patent
Park

(10) Patent No.: US 8,113,178 B2
(45) Date of Patent: Feb. 14, 2012

(54) APPARATUS AND METHOD FOR CONTROLLING QUANTITY OF FUEL OVER COMMON RAIL DIESEL ENGINE

(75) Inventor: Dong Won Park, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 329 days.

(21) Appl. No.: 12/491,995

(22) Filed: Jun. 25, 2009

(65) Prior Publication Data

US 2010/0126469 A1 May 27, 2010

(51) Int. Cl.
*F02M 51/00* (2006.01)
*F02M 59/46* (2006.01)

(52) U.S. Cl. ..... 123/478; 123/467; 701/105

(58) Field of Classification Search ..... 123/478, 123/480, 467; 701/102–105, 115
See application file for complete search history.

(56) References Cited

U.S. PATENT DOCUMENTS 5,402,760 A * 4/1995 Takeuchi et al. ..... 123/300
6,311,669 B1 * 11/2001 Przymusinski et al. ..... 123/300
6,752,126 B2 * 6/2004 Pfaeffle et al. ..... 123/436
7,152,575 B2 * 12/2006 Fritsch et al. ..... 123/299
7,255,087 B2 * 8/2007 Kanne et al. ..... 123/299
7,269,500 B2 * 9/2007 Cochet et al. ..... 701/114
7,523,743 B1 * 4/2009 Geveci et al. ..... 123/486
7,558,665 B1 * 7/2009 Geveci et al. ..... 701/104
7,717,088 B2 * 5/2010 Thomas ..... 123/478
7,900,605 B2 * 3/2011 Dingle ..... 123/480
7,920,957 B2 * 4/2011 Mattes et al. ..... 701/104
2003/0121501 A1 * 7/2003 Barnes et al. ..... 123/446
2006/0130812 A1 * 6/2006 Tsutsui ..... 123/446
2006/0243243 A1 * 11/2006 Fukasawa ..... 123/299
2011/0000465 A1 * 1/2011 Stoecklein et al. ..... 123/478

* cited by examiner

*Primary Examiner* — Thomas Moulis
(74) *Attorney, Agent, or Firm* — Morgan, Lewis & Bockius LLP

(57) ABSTRACT

An apparatus for controlling the quantity of fuel over a common rail diesel engine includes a wave speed correction map correcting a wave speed and a time corrector, a first adder multiplying the corrected wave speed by an injection time difference, a base correction map using an output of the first adder and a former injection quantity as input variables, an amplitude map using a following injection quantity and a rail pressure as input variables, and a second adder multiplying a base correction map value of the base correction map by an amplitude map value of the amplitude map, and outputting a finally corrected value of the fuel quantity.

14 Claims, 7 Drawing Sheets

APPARATUS AND METHOD FOR CONTROLLING QUANTITY OF FUEL OVER COMMON RAIL DIESEL ENGINE

CROSS-REFERENCE TO RELATED APPLICATION

The present application claims priority to Korean Patent Application No. 2008-0119211 filed on Nov. 27, 2008, the entire contents of which are incorporated herein for all purposes by this reference.

BACKGROUND OF THE INVENTION

1. Field of the Invention

The present invention relates to an apparatus and method for controlling the quantity of fuel over a common rail diesel engine, and more particularly, to an apparatus and method for controlling the quantity of fuel over a common rail diesel engine, which make it possible to reduce a deviation in the quantity of injected fuel using a map having a fuel temperature and a rail pressure as variables of a pressure wave correction (PWC) logic, reduce exhaust gases from the common rail diesel engine, and improve fuel efficiency of the common rail diesel engine.

2. Description of the Related Art

In general, the fuel injection system of a common rail diesel engine includes an injection pressure generating process and an injecting process, both of which are completely separated from each other. Thus, the common rail system can freely design burning and injecting processes because the injection pressure generation of fuel can be regarded separately from injection of fuel in the design of the engine. In detail, since both injection pressure and injection timing of the fuel can be regulated according to conditions of engine operation using an engine map, the fuel can be injected at high pressure even when revolutions per minute (rpm) of the engine is low, so that complete combustion can be accomplished. Further, pilot injection allows exhaust gases and noise to be further reduced, and the fuel injection is hydraulically controlled by a nozzle needle, so that it can be rapidly controlled until the injection is completed.

With the development of diesel engine technologies, there has recently been developed technology that performs multiple injections on diesel fuel during each combustion stroke.

FIG. 1 is a graph showing a change in the pressure of fuel during injection of fuel.

As can be seen from the graph of FIG. 1, in the case of multiple injections of fuel, a quantity of fuel injected later is affected by a quantity of fuel injected previously as well as a time difference between two injections of fuel, because the pressure is varied in a rail, a high-pressure pipe, and injectors.

This variation of the pressure causes a difference between quantities of injected fuel. In order to correct the difference between quantities of injected fuel, correction logic is used.

FIG. 2 conceptually illustrates the correction logic of a conventional apparatus for controlling the quantity of fuel over a common rail diesel engine.

As illustrated in FIG. 2, the correction logic properly corrects the quantity of fuel using a base map and an amplitude map. The base map is adapted to obtain a normalized reference valve on the basis of a time difference between two fuel injections and a fuel quality required for the second injection. The amplitude map is adapted to obtain a correction weight of the quantity of fuel by both a fuel quality required for the first injection and pressure in the rail.

FIG. 3 is a graph showing a change in the quantity of fuel caused by rail pressure of a conventional common rail diesel engine.

In FIG. 3, the change in the quantity of fuel is measured with respect to five rail pressures of 250 bar, 300 bar, 800 bar, 1200 bar and 1400 bar. This data is used when the base map of an existing logic is prepared. However, depending on a change in pressure, a waveform showing the change in the quantity of fuel is shifted, and a period (or frequency) of the waveform is varied. As such, the preparation of a map representative of all the cases using a single curve not only provides very low accuracy, but also requires much time and high expenses to a future verification test and re-correction.

Further, all of the existing correction logics are adapted to prepare the base and amplitude maps on the basis of the same time, so that the maps prepared so as to be well matched on some time sections are not well matched on other time sections.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an apparatus and method for controlling the quantity of fuel over a common rail diesel engine, in which a correction logic is equipped with a wave speed correction map having a fuel temperature and a rail pressure as input variables, thereby making it possible to remarkably reduce a deviation of the quantity of injected fuel, reduce exhaust gases from the engine, and improve fuel efficiency.

In an aspect of the present invention, an apparatus for controlling a fuel quantity over a common rail diesel engine may include a wave speed correction map correcting a wave speed, a first adder multiplying the corrected wave speed by an injection time difference, a base correction map using an output of the first adder and a former injection quantity as input variables, an amplitude map using a following injection quantity and a rail pressure as input variables, and a second adder multiplying a base correction map value of the base correction map by an amplitude map value of the amplitude map, and outputting a finally corrected value of the fuel quantity.

The apparatus for controlling a fuel quantity over a common rail diesel engine may further include a time corrector disposed between the first adder and the base correction map, wherein the time corrector corrects a difference between a calculated valve open/close time and an actual hydraulic valve open/close time on a basis of a result of the first adder, the rail pressure, and a fuel temperature, and outputs a corrected injection time difference as a variable to the base correction map.

The time corrector may include a hydraulic movement correction map using the rail pressure and the fuel temperature as input variables, and a summer summing a hydraulic movement correction map value of the hydraulic movement correction map and the result of the first adder, and outputting the corrected injection time difference as a variable.

Each of the correction maps may include a fuel temperature and the rail pressure as input variables.

The injection time difference may be a difference between a previous injection time and a current injection time.

The injection time difference may be a difference between a previous injection time and a current injection time.

The correction map may include a fuel temperature and the rail pressure as input variables.

In another aspect of the present invention, an apparatus for controlling a fuel quantity over a common rail diesel engine, may include a wave speed correction map configured to correct a wave speed based on at least one input parameter, wherein an output of the wave speed correction map is configured to correct a first input parameter, a base correction map configured to correct the corrected first input parameter based on a second input parameter, and an output member configured to output a finally corrected value of the fuel quantity, based on an output of the base correction map and an output of an amplitude map, wherein the amplitude map includes one of the at least one input parameter of the wave speed correction map and a third input parameter as input values.

The first input parameter may be an injection time difference determined by a difference between a previous injection time and a current injection time.

The second input parameter may be a former injection quantity.

The third input parameter may be a following injection quantity.

The one of the at least one input parameter of the wave speed correction map may be a fuel pressure in a common rail.

The other of the at least one input parameter of the wave speed correction map may be a fuel temperature.

The wave speed correction map may be configured to correct the wave speed based on the one and the other of the at least one input parameter of the wave speed correction map, wherein the other of the at least one input parameter of the wave speed correction map is a fuel temperature.

The apparatus for controlling a fuel quantity over a common rail diesel engine may further include a time correcting member configured to correct the corrected first input parameter wherein the corrected first input parameter is corrected based on the one and the other of the at least one input parameter of the wave speed correction map so as to correct a time difference between a calculated valve open/close time and an actual hydraulic valve open/close time, wherein the time correcting member includes a hydraulic movement correction map having the one and the other of the at least one input parameter of the wave speed correction map as input variable, wherein the one and the other of the at least one input parameter of the wave speed correction map are a fuel pressure in a common rail and a fuel temperature respectively.

In further another aspect of the present invention, a method for controlling a quantity of fuel over a common rail diesel engine, may include multiplying a weight of a wave speed, which is corrected by a wave speed correction map having a fuel temperature and a rail pressure as input variables, by an injection time difference as a variable, calculating a corrected injection time difference, which corrects a difference between a calculated valve open/close time and an actual hydraulic valve open/close time, using the value obtained by multiplying the wave speed weight by the injection time difference, calculating a base correction map value using the calculated corrected injection time difference and a former injection quantity of fuel, calculating an amplitude map value using a following injection quantity of fuel and the rail pressure, and determining a finally corrected value of the fuel quantity using the base correction map value and the amplitude map value.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 4:
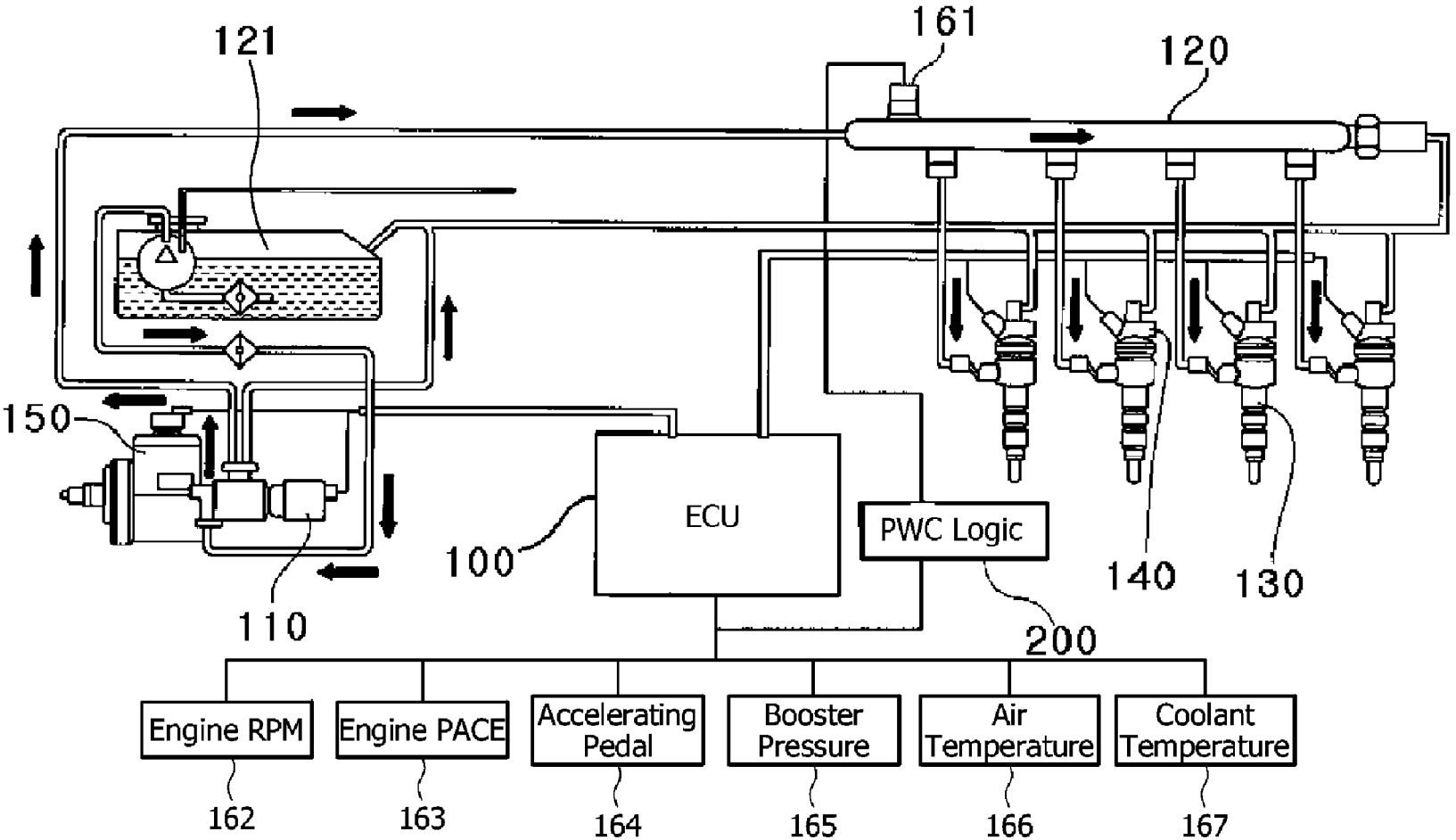
FIG. 4 schematically illustrates the configuration of an exemplary common rail fuel injection system according to the present invention.

FIG. 4 schematically illustrates the configuration of a common rail fuel injection system according to various embodiments of the present invention.

The common rail fuel injection system includes an electronic control unit 100, a high-pressure pump 150, a fuel feed regulating valve 110, a common rail 120, injectors 130, injector coils 140, a variety of sensors 161 through 167, and a pressure wave correction (PWC) logic 200 for controlling the quantity of fuel over a common rail diesel engine.

The high-pressure pump 150 is a pump using a rotational force of the diesel engine, and is configured to compress the fuel supplied from the fuel tank 121 up to maximum 1,350 bar, and then feed the compressed fuel to the common rail 120. The fuel feed regulating valve 110 is mounted in the high-pressure pump 150, and regulates the quantity of fuel fed to a high-pressure chamber of the high-pressure pump 150 under the control of the electronic control unit 100 to thereby control the quantity of fuel required for the engine.

The common rail 120 stores the high-pressured fuel feed from the high-pressure pump 150 and then feeds the fuel to each combustion chamber at the same pressure, and is equipped with a check valve for preventing a backflow and a high-pressure sensor 161. The pressure of the fuel in the common rail is regulated by an electromagnetic pressure regulating valve, is always monitored by the high-pressure sensor, and is continuously regulated according to conditions required by the engine.

Each injector 130 serves to inject the high-pressure fuel into the combustion chamber. Each injector coil 140 is actuated under the control of the electronic control unit 100, thereby opening/closing a needle valve of each injector 130.

The electronic control unit 100 receives signals detected by the sensors 161 through 167, thereby actuating a high-pressure fuel pump, the fuel feed regulating valve 110, the injector coils 140, etc. to control the quantity of fuel, injection time, injection rate, and so on.

According to various embodiments of the present invention, the quantity of injected fuel is corrected using a wave speed correction map, in which both pressure in the common rail and temperature of the fuel are set as input variables, in the PWC logic 200. This is because the quantity of injected fuel has a variable value depending on a level of the pressure in the common rail. In other words, a pressure wave in the high-pressure fuel pipe is subjected to a change in its period, etc. by a wave speed. The wave speed can be mathematically given as follows.

Figure 1:
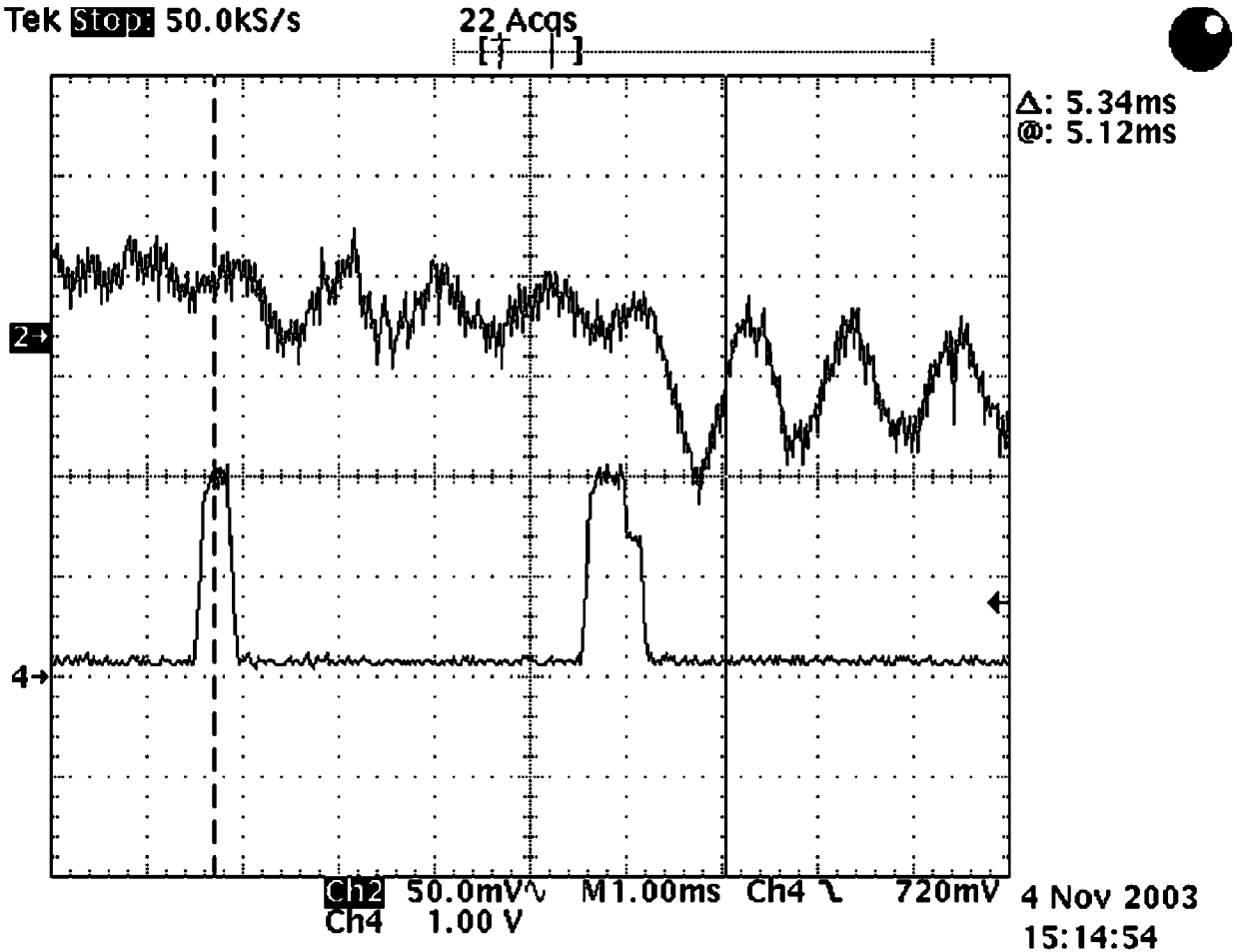
FIG. 1 is a graph showing a change in the pressure of fuel during injection of fuel.
Figure 2:
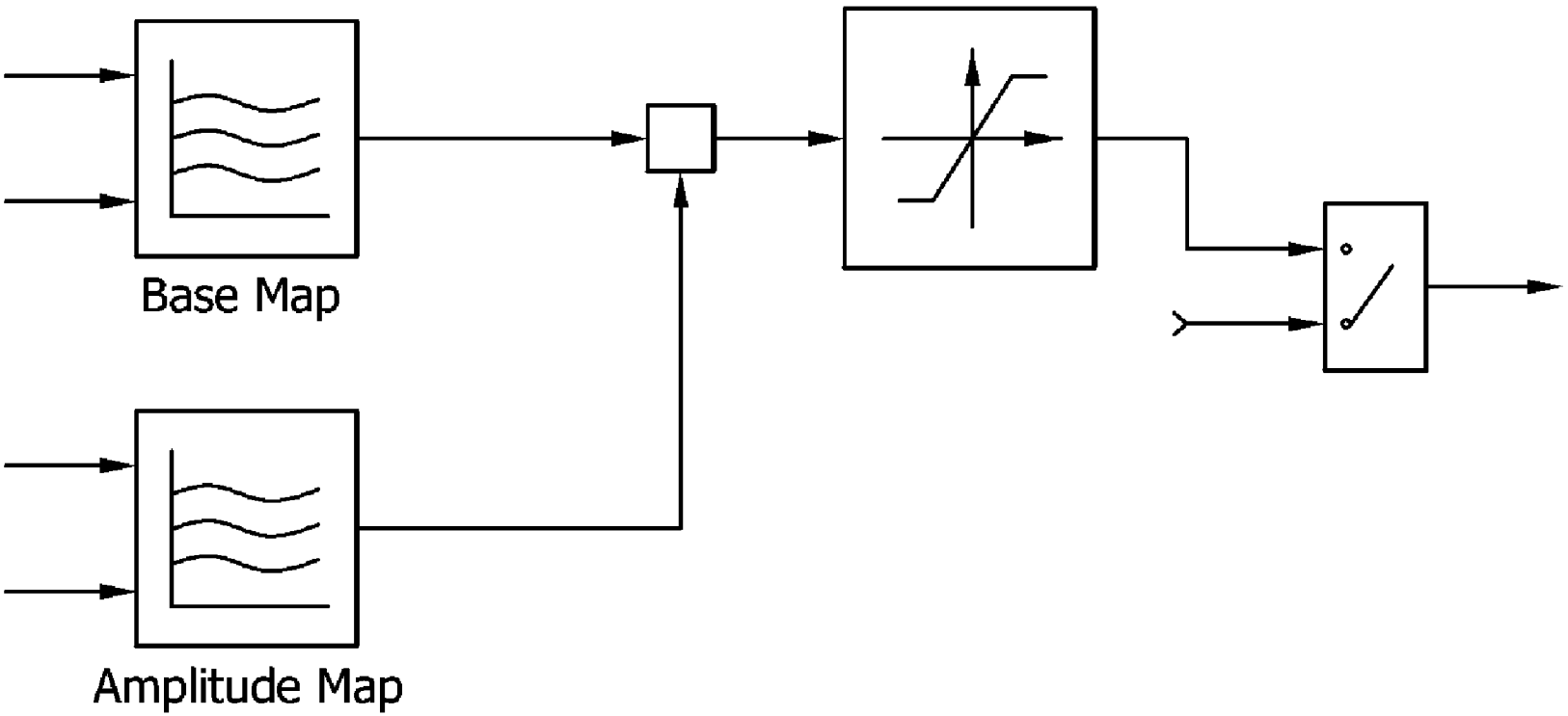
FIG. 2 (Prior Art)
FIG. 2 conceptually illustrates the correction logic of a conventional apparatus for controlling the quantity of fuel over a common rail diesel engine.
Figure 3:
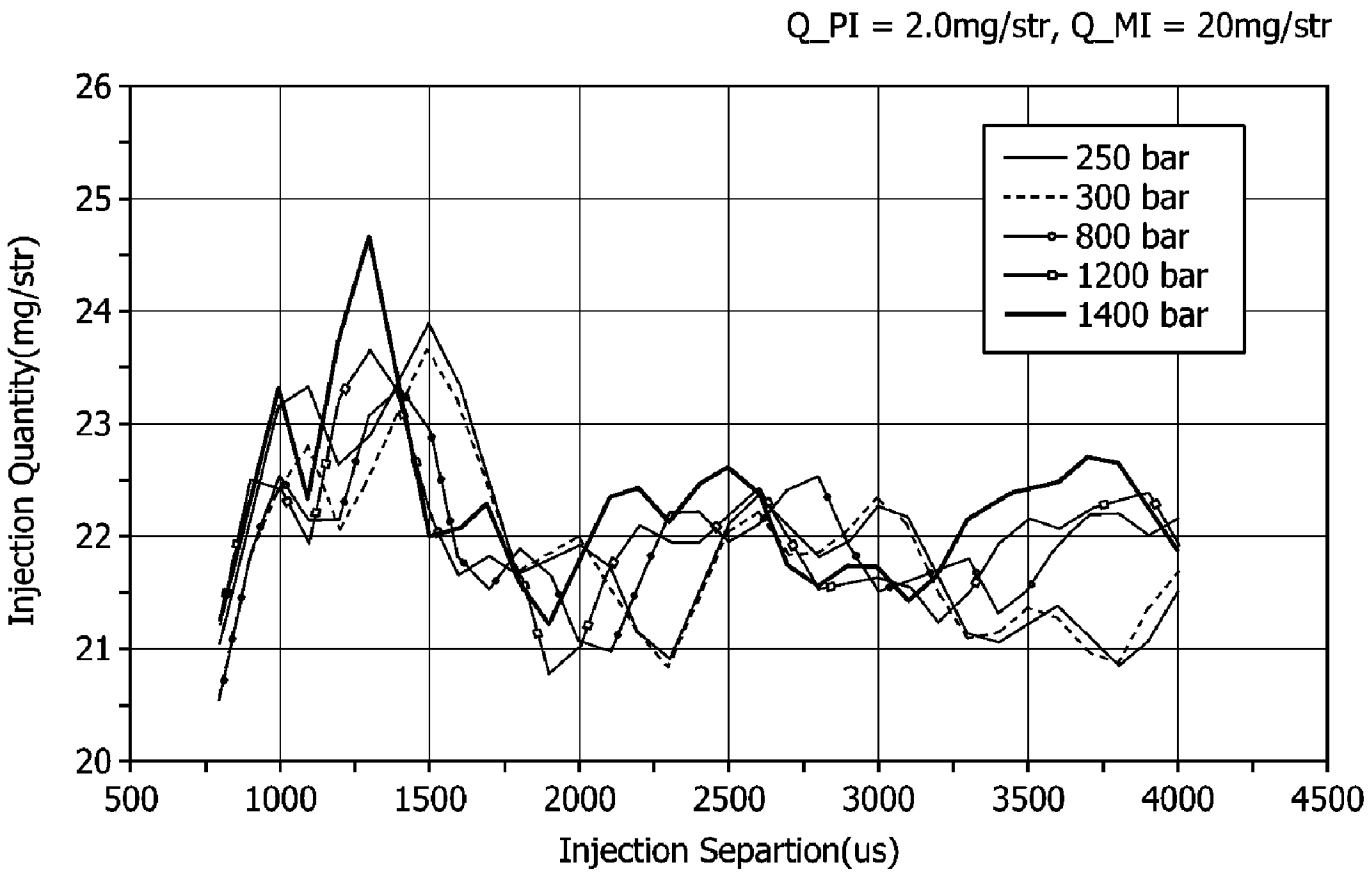
FIG. 3 (Prior Art)
FIG. 3 is a graph showing a change in the quantity of fuel caused by rail pressure of a conventional common rail diesel engine.

The wave speed "c" of liquid in the pipe is expressed by the following Equation 1:

$$c=\sqrt{\sqrt{\gamma B_T/\rho_o}} \qquad \text{Equation 1}$$

where γ is the ratio of heat capacity, BT is the isothermal bulk modulus, and ρo is the volume density. All of the three variables possess the property of being varied by temperature and pressure of the liquid. Thus, the wave speed "c" is the function of the rail pressure and the fuel temperature, and the wave in the fuel pipe is subjected to a change in its frequency and wavelength according to pressure. As such, in the case of the graph of FIG. 3 illustrating a change in the quantity of fuel, an injection separation (i.e. an injection time difference) has also to be corrected on the basis of the rail pressure and the fuel temperature.

According to various embodiments of the present invention, the quantity of injected fuel is corrected using the wave speed correction map, in which the rail pressure and the fuel temperature are set as the input variables, in the PWC logic 200.

Now, the aforementioned PWC logic 200 will be described in detail with reference to the figures.

Figure 5:
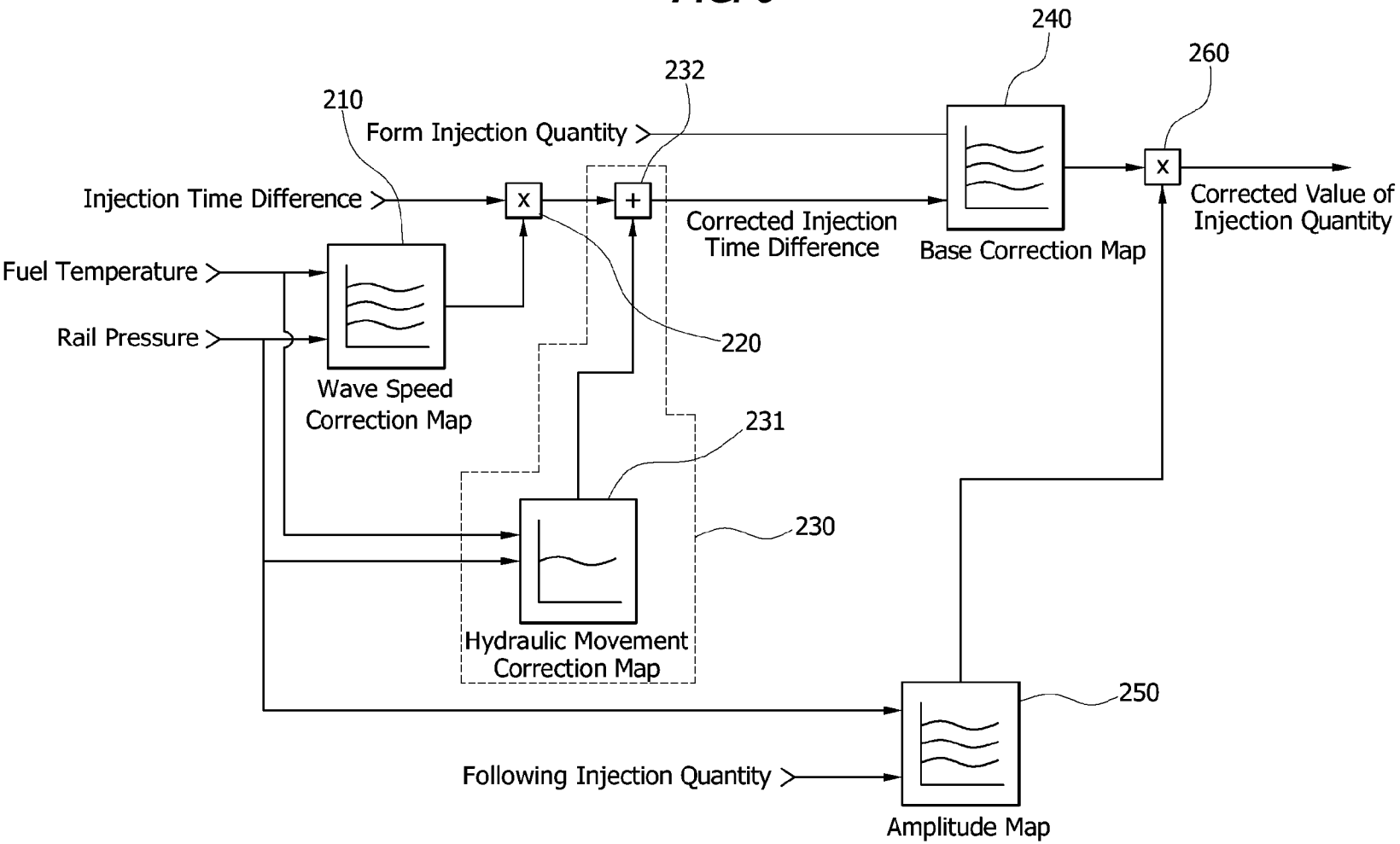
FIG. 5 conceptually illustrates a PWC logic in an apparatus for controlling the quantity of fuel over an exemplary common rail diesel engine according to the present invention.

FIG. 5 conceptually illustrates a PWC logic in an apparatus for controlling the quantity of fuel over a common rail diesel engine according to an exemplary embodiment of the present invention.

As illustrated in FIG. 5, the PWC logic includes a wave speed correction map 210 correcting a wave speed using the fuel temperature and the rail pressure as the input variables, a first adder 220 multiplying the corrected wave speed by an injection time difference, a time corrector 230 correcting a difference between an electrical valve open/close time (i.e. a valve open/close time calculated by the electronic control unit 100) and a hydraulic valve open/close time (i.e. an actual valve open/close time) on the basis of the result of the first adder 220, the rail pressure, and the fuel temperature, and outputting a corrected injection time difference as a variable, a PWC base correction map 240 using the corrected injection time difference and a former injection quantity as input variables, a PWC amplitude map 250 using the rail pressure and a following injecting quantity as input variables, and a second adder 260 multiplying a PWC base correction map value of the PWC base correction map 240 by a PWC amplitude map value of the PWC amplitude map 250, and outputting a finally corrected value of the PWC fuel quantity.

As described above, the wave speed correction map 210 uses the fuel temperature and the rail pressure as input variables. As in the aforementioned Equation 1, a wave speed corresponding to that of liquid is corrected. In other words, a weight is added to the wave speed.

The wave speed correction map 210 is to correct the wave speed that is a physical phenomenon. A map prepared for a given engine can be used in common with other engines without great correction. Thereby, test number and time that are required for correction and complement in order to prepare the map can be remarkably reduced.

Here, the first and second adders 220 and 260 multiply the mapped values. At this time, the injection time difference refers to that between two sections, i.e. between a former injection time and a current injection time.

The time corrector 230 includes a hydraulic movement correction map 231 using the rail pressure and the fuel temperature as input variables, and a summer 232 summing a hydraulic movement correction map value of the hydraulic movement correction map 231 and the result of the first adder 220 to thereby output the corrected injection time difference as a variable.

The value output from the time corrector 230, i.e. the corrected injection time difference, is a value that corrects a difference between the valve open/close time pre-calculated by the electronic control unit 100 and the actually measured valve open/close time. Thereby, a difference between a theoretical value and an actual value can be easily corrected with respect to the valve open/close time.

If necessary, the time corrector 230 may be removed. In this case, the PWC base correction map 240 receives the output of the first adder 220 and the former injection quantity as input variables.

The PWC base correction map 240 outputs the PWC base correction map value using the former injection quantity of fuel and the corrected injection time difference as input variables. The PWC amplitude map 250 outputs the PWC amplitude map value using a currently measured rail pressure and the following injection quantity of fuel as input variables.

In this manner, the PWC base correction map 240 receives the former injection quantity of fuel and the corrected injection time difference that is a new variable, and then outputs a mapping value corresponding to these variables, so that it can easily record its data. Similarly, the PWC amplitude map 250 can easily record its data as well.

The operation of the PWC logic 200 having the aforementioned configuration will be described with reference to FIG. 5.

First, the weight of a wave speed corrected by the wave speed correction map 210 having the fuel temperature and the rail pressure as input variables is multiplied by an injection time difference.

A corrected injection time difference, which corrects a difference between a calculated valve open/close time and an actual hydraulic valve open/close time, is calculated using the value obtained by multiplying the wave speed weight by the injection time difference.

A PWC base correction map value is obtained using the corrected injection time difference calculated in this way and a former injection quantity of fuel. Subsequently, a PWC amplitude map value using the following injection quantity of fuel and the rail pressure as input variables is obtained, and then the PWC base correction map value is multiplied by the PWC amplitude map value. Thereby, a finally corrected value of the PWC fuel quantity is obtained.

In comparison with a conventional PWC logic, the PWC logic can conspicuously reduce a deviation in the quantity of injected fuel.

Figure 6:
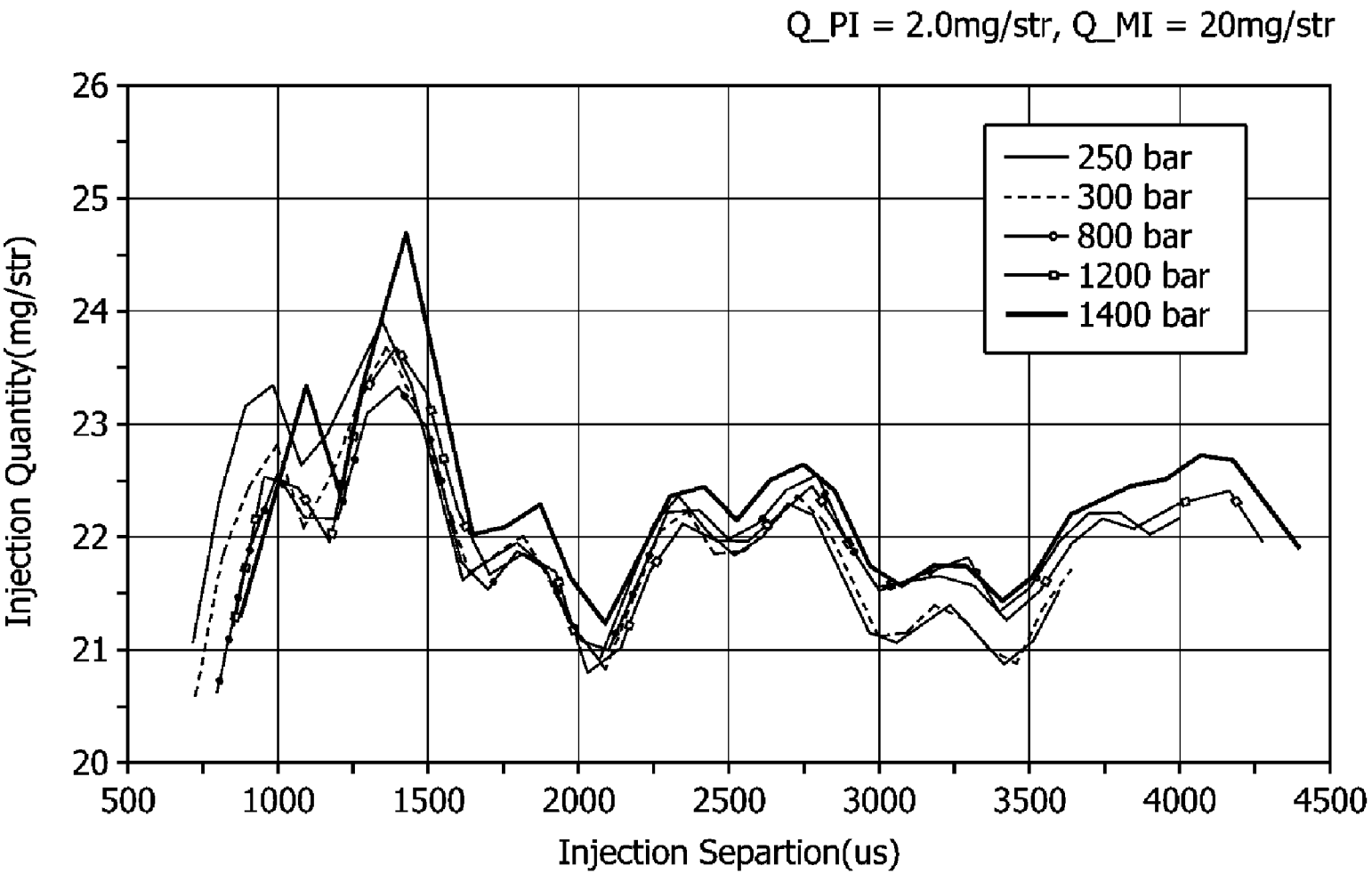
FIG. 6 is a graph representing a change in the quantity of fuel when an injection time difference is corrected on the basis of a wave speed according to various embodiments of the present invention.

FIG. 6 is a graph representing a change in the quantity of fuel when an injection time difference is corrected on the basis of a wave speed according to an exemplary embodiment of the present invention.

In FIG. 6, the change in quantity of fuel is measured with respect to five rail pressures of 250 bar, 300 bar, 800 bar, 1200 bar and 1400 bar, and the injection time difference between the two injections (i.e. the first injection and the following second injection) is corrected on the basis of the wave speed. In this manner, when the injection time difference is corrected, it can be seen that the change in quantity of fuel has a more regular form as compared to the graph of FIG. 3.

Figure 7:
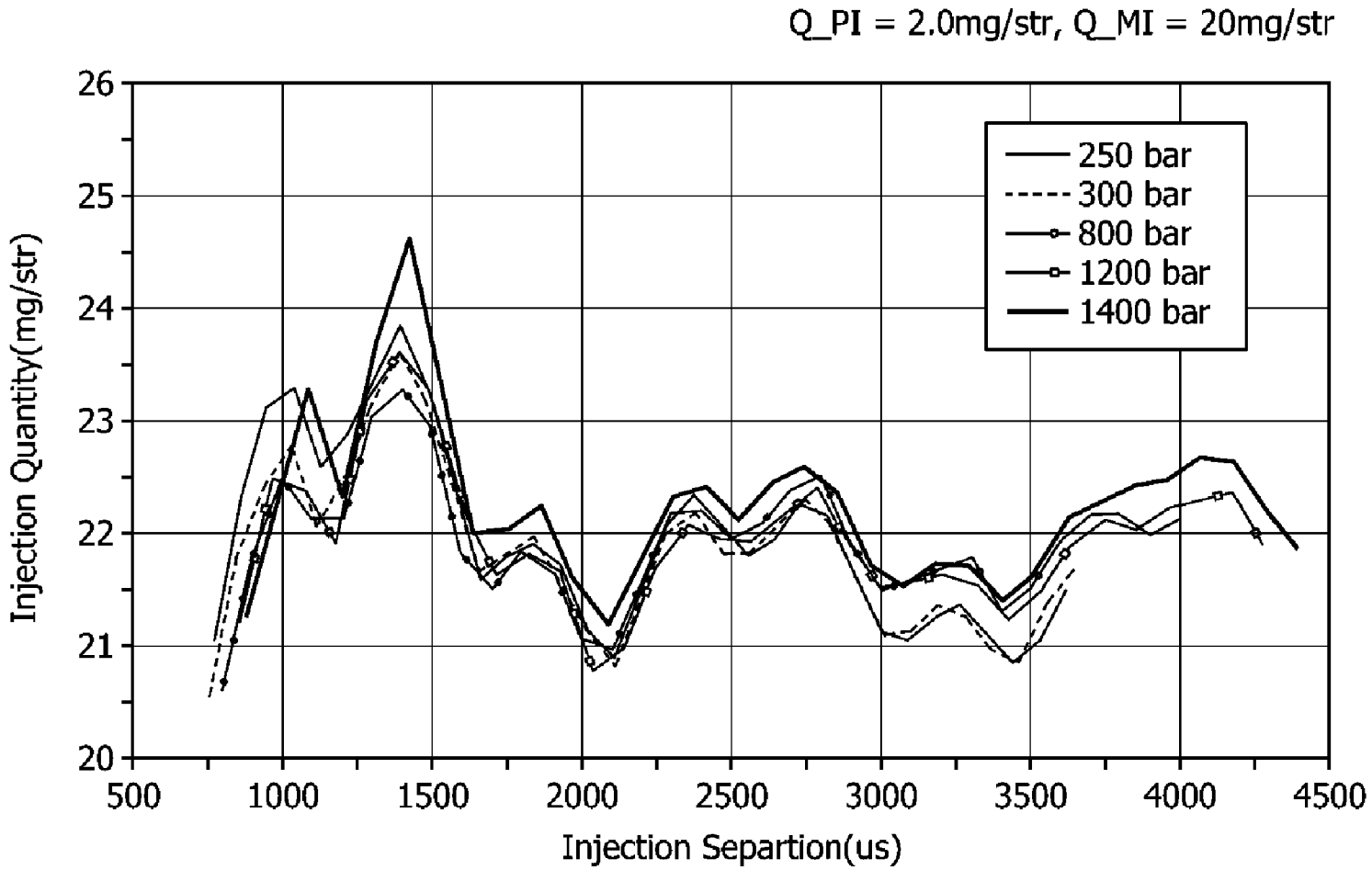
FIG. 7 is a graph representing a change in the quantity of fuel when an injection time difference is corrected on the basis of a wave speed, and when a difference between a calculated valve open/close time and an actual hydraulic valve open/close time is additionally corrected, according to various embodiments of the present invention.

FIG. 7 is a graph representing a change in the quantity of fuel when an injection time difference is corrected on the basis of a wave speed, and when a difference between a calculated valve open/close time and an actual hydraulic valve open/close time is additionally corrected, according to various embodiments of the present invention.

In FIG. 7, the change in the quantity of fuel is measured with respect to five rail pressures of 250 bar, 300 bar, 800 bar, 1200 bar and 1400 bar, and the injection time difference is corrected through the PWC logic in additional consideration of the difference between the electrical valve open/close time and an actual hydraulic valve open/close time of each injector. In this manner, when the injection time difference is corrected in addition to the valve open/close time difference, it can be seen that the change in quantity of fuel has a more regular form with respect to each pressure, as compared to the graph of FIG. 6. In particular, positions of wave peaks can be better matched.

According to various aspects of the present invention, the apparatus and method for controlling the quantity of fuel over a common rail diesel engine make it possible to easily prepare data of a map through a pressure wave correction (PWC) logic having the wave speed correction map using a fuel temperature and a rail pressure, remarkably reduce number and time of tests that are required for correction and complement in order to prepare the map, reduce a deviation of the fuel quantity as well as exhaust gases, and improve fuel efficiency The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for controlling a quantity of fuel over a common rail diesel engine, the apparatus comprising:

a wave speed correction map correcting a wave speed;

a first adder multiplying the corrected wave speed by an injection time difference;

a base correction map using an output of the first adder and a former injection quantity as input variables;

an amplitude map using a following injection quantity and a rail pressure as input variables;

a second adder multiplying a base correction map value of the base correction map by an amplitude map value of the amplitude map, and outputting a finally corrected value of the fuel quantity; and a time corrector disposed between the first adder and the base correction map, wherein the time corrector corrects a difference between a calculated valve open/close time and an actual hydraulic valve open/close time on a basis of a result of the first adder, the rail pressure, and a fuel temperature, and outputs a corrected injection time difference as a variable to the base correction map.

wherein the time corrector includes:

a hydraulic movement correction map using the rail pressure and the fuel temperature as input variables; and a summer summing a hydraulic movement correction map value of the hydraulic movement correction map and the result of the first adder, and outputting the corrected injection time difference as a variable.

2. The apparatus according to claim 1, wherein each of the correction maps includes a fuel temperature and the rail pressure as input variables.

3. The apparatus according to one of claim 1, wherein the injection time difference is a difference between a previous injection time and a current injection time.

4. The apparatus according to one of claim 1, wherein the injection time difference is a difference between a previous injection time and a current injection time

5. The apparatus according to claim 1, wherein the correction map includes a fuel temperature and the rail pressure as input variables.

6. An apparatus for controlling a fuel quantity over a common rail diesel engine, the apparatus comprising:

a wave speed correction map configured to correct a wave speed based on at least one input parameter, wherein an output of the wave speed correction map is configured to correct a first input parameter;

a base correction map configured to correct the corrected first input parameter based on a second input parameter;

an output member configured to output a finally corrected value of the fuel quantity, based on an output of the base correction map and an output of an amplitude map, wherein the amplitude map includes one of the at least one input parameter of the wave speed correction map and a third input parameter as input values; and a time correcting member configured to correct the corrected first input parameter wherein the corrected first input parameter is corrected based on the one and the other of the at least one input parameter of the wave speed correction map so as to correct a time difference between a calculated valve open/close time and an actual hydraulic valve open/close time wherein the time correcting member includes a hydraulic movement correction map having the one and the other of the at least one input parameter of the wave speed correction map as input variable, and wherein the second input parameter is a former injection quantity.

7. The apparatus according to claim 6, wherein the first input parameter is an injection time difference determined by a difference between a previous injection time and a current injection time.

8. The apparatus according to claim 6, wherein the third input parameter is a following injection quantity.

9. The apparatus according to claim 6, wherein the one of the at least one input parameter of the wave speed correction map is a fuel pressure in a common rail.

10. The apparatus according to claim 6, wherein the other of the at least one input parameter of the wave speed correction map is a fuel temperature.

11. The apparatus according to claim 6, wherein the wave speed correction map is configured to correct the wave speed based on the one and the other of the at least one input parameter of the wave speed correction map.

12. The apparatus according to claim 11, wherein the other of the at least one input parameter of the wave speed correction map is a fuel temperature.

13. The apparatus according to claim 6, wherein the one and the other of the at least one input parameter of the wave speed correction map are a fuel pressure in a common rail and a fuel temperature respectively.

14. A method for controlling a quantity of fuel over a common rail diesel engine, the method comprising:

multiplying a weight of a wave speed, which is corrected by a wave speed correction map having a fuel temperature and a rail pressure as input variables, by an injection time difference as a variable;

calculating a corrected injection time difference, which corrects a difference between a calculated valve open/close time and an actual hydraulic valve open/close time, using the value obtained by multiplying the wave speed weight by the injection time difference;

calculating a base correction map value using the calculated corrected injection time difference and a former injection quantity of fuel;

calculating an amplitude map value using a following injection quantity of fuel and the rail pressure; and determining a finally corrected value of the fuel quantity using the base correction map value and the amplitude map value.

* * * * *